US007372024B2

(12) United States Patent
Mordehai et al.

(10) Patent No.: US 7,372,024 B2
(45) Date of Patent: May 13, 2008

(54) TWO DIMENSIONAL ION TRAPS WITH IMPROVED ION ISOLATION AND METHOD OF USE

(75) Inventors: Alexander Mordehai, Santa Clara, CA (US); Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 259 days.

(21) Appl. No.: 11/224,120

(22) Filed: Sep. 13, 2005

(65) Prior Publication Data

US 2007/0057175 A1 Mar. 15, 2007

(51) Int. Cl.
*H01J 49/42* (2006.01)

(52) U.S. Cl. ..... 250/292; 250/282

(58) Field of Classification Search ..... None
See application file for complete search history.

(56) References Cited

U.S. PATENT DOCUMENTS 4,761,545 A 8/1988 Marshall et al.
5,324,939 A 6/1994 Louris et al.
5,331,157 A 7/1994 Franzen
5,420,425 A 5/1995 Bier et al.
5,679,951 A * 10/1997 Kelley et al. ..... 250/282
5,696,376 A 12/1997 Doroshenko et al.
6,649,911 B2 11/2003 Kawato
6,897,438 B2 * 5/2005 Soudakov et al. ..... 250/288
2004/0051036 A1 3/2004 Franzen et al.
2006/0038123 A1 * 2/2006 Quarmby et al. ..... 250/292

OTHER PUBLICATIONS

Douglas, Donald J., et al., "Linear Quadrupoles with Added Octopole Fields", Department of Chemistry, University of British Columbia, Vancouver, BC, Canada, proceedings of the 51 ASMS, Canada Jun. 8-12, 1993.
Makarov, Alexander A., "Resonance Ejection form the Paul Trap: A Theoretical Treatment Incorporating a Weak Octapole Field", Analytical Chemistry, vol. 68, No. 23, Dec. 1, 1996.
March, Raymond E., et al, "Practical Aspects of Ion Trap Mass Spectrometry", Fundamental of Ion Trap Mass Spectrometry, vol. I, 1995.

* cited by examiner

*Primary Examiner*—Jack I. Berman

(57) ABSTRACT

An apparatus and method for isolation of selected ions of interest in a 2-D ion trap is provided. The 2-D ion trap of the invention has an octopole field which is obtained by modification of the electrodes, modification of the positioning of the electrodes or both. The 2-D ion trap of the invention also includes a means for forcing ion motion in the ion trap in a first and a second direction independently and sequentially.

21 Claims, 10 Drawing Sheets

TWO DIMENSIONAL ION TRAPS WITH IMPROVED ION ISOLATION AND METHOD OF USE

FIELD OF THE INVENTION

The invention generally relates to quadrupole ion traps and more particularly to two dimensional (2-D) quadrupole ion traps.

BACKGROUND OF THE INVENTION

Tandem mass spectrometry methods (MS/MS) are very useful for characterizing and/or quantifying a component of interest in a complex mixture and/or for deriving enhanced structural information from an analyte that yields limited fragmentation and/or has a feature that complicates quantification. Linear ion traps are one type of instrumentation commonly used for MS/MS. The term "linear ion trap" may include three dimensional ion traps (e.g. 3-D ion traps) made up of ring and end-cap electrodes forming a near ideal quadrupole field or ion traps comprising four pole rods (e.g., 2-D ion traps). In an ideal 3-D ion trap quadrupole field, a radio frequency (RF) field strength increases linearly both radially and axially and the repulsing pseudo-forces also increase linearly. The 2-D ion traps are made up of four rod electrodes in which the quadrupole field only changes along two coordinates (x, y) and remains constant along the third coordinate (z).

Typically, 3-D ion traps have a small octopole field in addition to the quadrupole field. The octopole component makes the 3-D ion trap a substantially non-linear resonating system (A. A. Makarov, Anal. Chem. 1996, 68, p. 4257-4263, Franzen, et al., Practical aspects of Ion Trap Mass Spectrometry, volume 1 p. 69 edited by R. E. March and J.F.J. Todd). This means that isolation is asymmetrical both below the m/z of interest and above it. With a positive sign of the octopole field the isolation window can be very sharp for m/z below the nominal m/z value and quite diffused above the nominal m/z value.

Isolation techniques such as those described in U.S. Pat. No. 5,324,939 do not recognize the non-linearity of the ion trap and focus on the construction of the ejection waveforms based on the assumption of a linear resonance system. As a result the isolation procedure requires a substantial amount of time (i.e., on the order of 20 to 60 ms) and the width of the isolation window is typically greater than 1 Da.

Franzen in U.S. Pat. No. 5,331,157 (the '157 Patent) recognized the non-linear behavior and non-symmetrical ion behavior around the m/z of interest and disclosed the use of a non-linear resonance to facilitate the ejection of M+1 species from an ion trap. However when using the technique of the '157 Patent, it is typically difficult to obtain an isolation window width better then 1Da. Further the ejection of ions with masses higher than the m/z of interest typically requires repeating the procedure. When using the technique of the '157 Patent, it is desirable to have a lower number of ions stored in the ion trap. Thus, typically the total number of ions that can be stored in the ion trap prior to isolation (e.g., the "isolation storage capacity") is limited.

U.S. Pat. No. 6,649,911 discloses a complex specially designed wave function used, with phase inversion at around the frequency that corresponds to the mass to be isolated, for trapping ions. Repeating application of the scan function is typically necessary to provide isolation of a well resolved ion species.

Superimposing a substantial contribution of an octopole field onto the pure quadrupole field of a 2-D ion trap has been suggested recently. (See Linear Quadrupoles with Added Octopole Fields, Sudakov at the Proceedings of the 51 ASMS, Canada, Jun. 8-12, 1993; and Franzen, U.S. Patent Publication U.S. 2004/0051036 A1). However, adding an octopole component in a 2-D ion trap utilizing prior art isolation methods typically results in a diffused isolation edge on the one side of the isolation window.

Accordingly, there is a need for isolation apparatus and methods for a 2-D ion trap with a superimposed octopole field.

SUMMARY OF THE INVENTION

The present invention includes a 2-D ion trap comprising, a trapping chamber. The ion trap includes a plurality of electrodes defining the trapping volume, a circuit for providing a substantially quadrupole radio frequency field (RF field) having a planar x-y geometry in the trapping volume and a circuit for providing an octopole field for distorting the planar x-y geometry of the quadrupole RF field. The ion trap may further include a means for introducing or forming ions in the trapping volume, and a means for forcing ion motion in a first direction and a second direction independently and sequentially.

The means for forcing ion motion in a first direction and a second direction independently may include a first means for generating an excitation wave frequency that provides an excitation wave frequency wherein the excitation wave frequency changes from a high frequency to a low frequency over time and a second means for generating an excitation wave frequency that provides an excitation wave frequency wherein the excitation wave frequency changes from a low frequency to a high frequency over time.

The means for distorting the planar quadrupole x-y geometry may be an octopole field. The ratio of the octapole field contribution to the quadrupole field contribution may be about 0.2% to about 5%.

The invention further comprises a method for trapping ions using the apparatus of the invention.

DETAILED DESCRIPTION OF THE FIGURES

DETAILED DESCRIPTION OF THE INVENTION

The present invention provides an apparatus and method for isolation of selected ions of interest in a 2-D ion trap. The apparatus and method provide for isolation resolution characterized by symmetrical sharp edges for the isolation window and, typically, a decrease in the time needed for isolation of ions. The apparatus comprises a trapping chamber including a plurality of electrodes defining a trapping volume, a circuit for providing an RF field in the trapping volume, a circuit for providing an octopole field in the trapping volume, and first and second supplemental wave form generators. Further, the present invention provides a method for improved ion isolation that is substantially insensitive to the presence of large number of ions within the 2-D trap (e.g., the method has high ion capacitance with respect to the isolation procedure).

Figure 1:
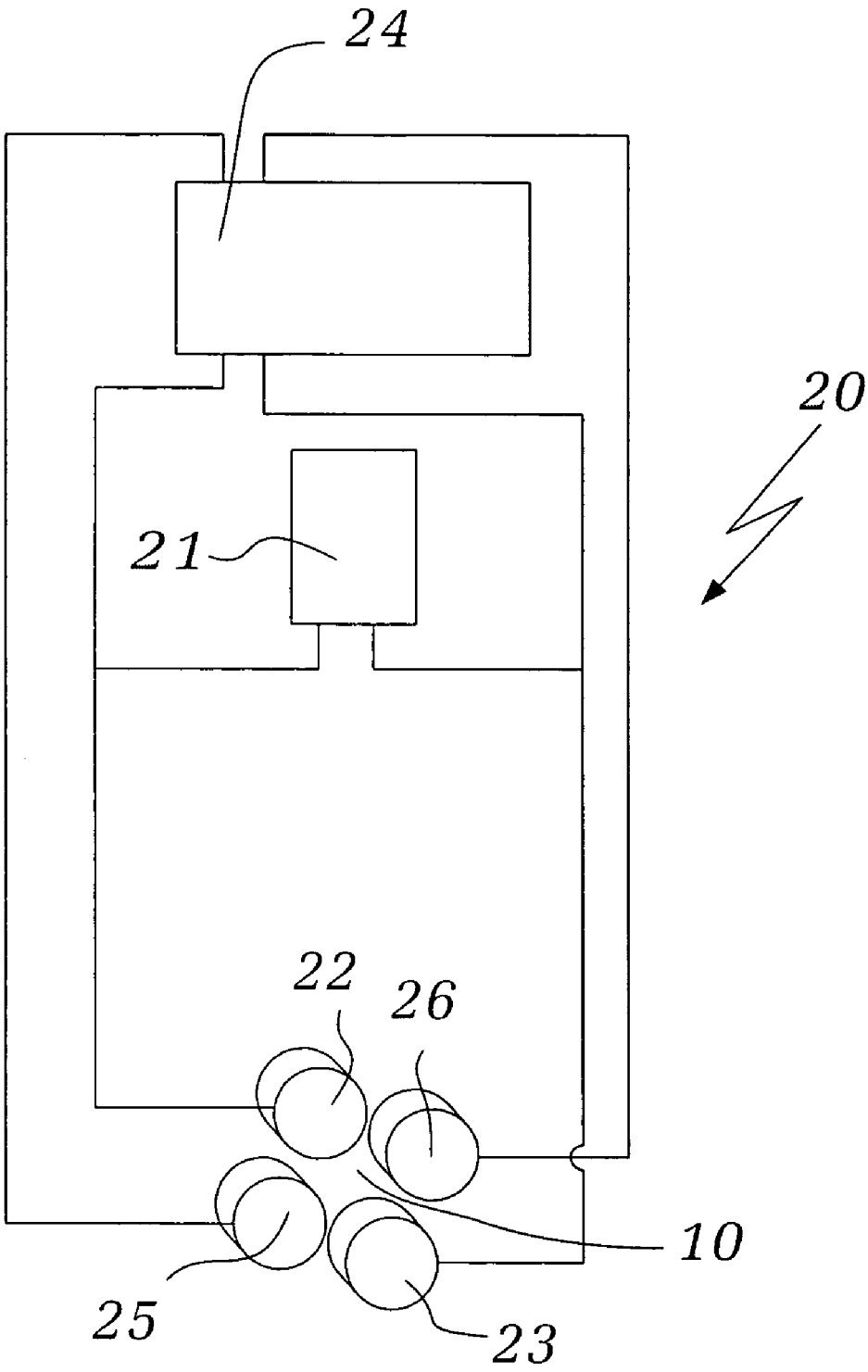
Figure 1 (Prior Art)
FIG. 1 is a schematic diagram of a prior art 2-D ion trap.

An exemplary prior art 2-D ion trap comprising a quadrupole filter with input and exit plates and rod electrodes is shown in FIG. 1. In the ion trap 20 as shown in FIG. 1, the quadrupole filter comprises four round rod electrodes 22, 23, 25, 26 which form a quadrupole field ion trapping volume 10 (e.g. "trapping volume"). Alternatively, hyperbolic rod electrodes may be employed. Referring to FIG. 1, isolation is accomplished in the 2-D prior art ion trap 20 by connecting a single supplemental isolation wave-form generator 21 to one pair of opposite rod electrodes 22, 23, and connecting the main RF generator 24 symmetrically to all four rod electrodes 22, 23, 25, 26. "Connecting" or "connected" may include physical connection and/or electrical connection, and/or being in electrical communication. Unlike commercial 3-D ion trap mass analyzes, the conventional 2-D ion trap field does not have any significant octopole field contribution.

Figure 2:
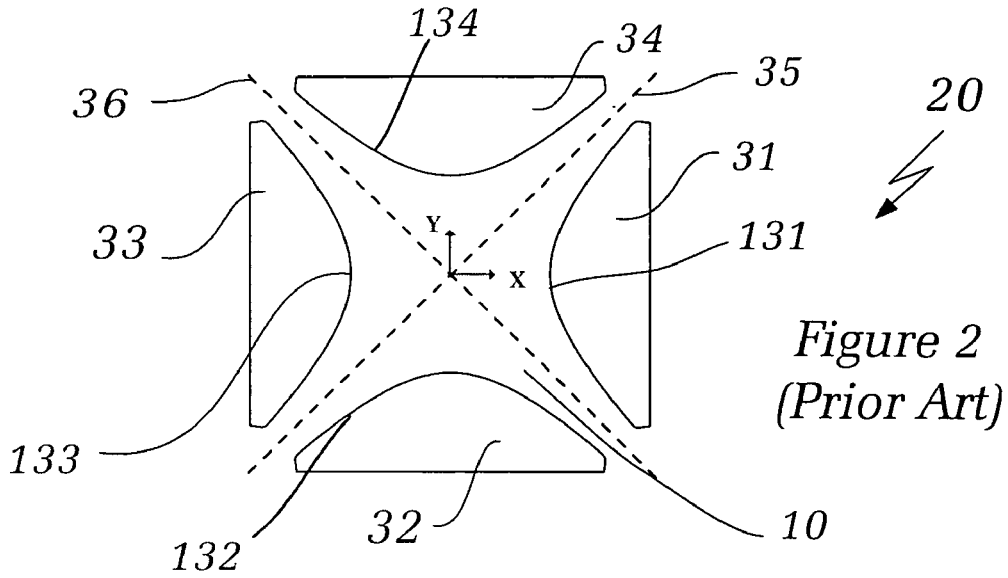
Figure 2 (Prior Art)
FIG. 2 is a schematic cross section diagram of a prior art 2-D ion trap with hyperbolic electrodes.

FIG. 2 shows a cross-section of an exemplary conventional 2-D ion trap 20 formed by a four hyperbolic electrodes 31, 32, 33, 34. An ideal hyperbolic electrode has an angle of 90 degrees between the two asymptotes of the hyperbola. The ideal electrical field within the x-y plane is substantially a quadrupole RF field. The ideal quadrupole field can be described by the following equation:

$$\Psi(x, y) = \frac{x^2 - y^2}{R_0^2}(U - V\sin vt) \tag{1}$$

where U and V are the DC and RF voltages applied to the opposite electrodes of the electrode pairs, and v is the frequency of the RF voltage. For the example shown in FIG. 2, electrodes 32 and 34 form an electrode pair and electrodes 31 and 33 form a second electrode pair. Further, the electrodes have hyperbolic inner surfaces 131, 132, 133, 134. An electrode inner surface should be taken to mean the surface of an electrode adjacent the trapping volume 10.

In practice the actual electric field is slightly different from theoretical quadropole field described by the equation (1) due to the truncation of the hyperbolic surfaces of the electrodes. It is convenient to represent the actual electric field by the following expansion series:

$$\Psi(x, y) = \left\{ \begin{array}{c} A_0 + A_2\dfrac{x^2 - y^2}{R_0^2} + \\ A_4\dfrac{x^4 + 6x^2y^2 + y^4}{R_0^4} + \\ A_6\dfrac{P_6(x, y)}{R_0^6} + o(x, y) \end{array} \right\}(U - V\sin vt) \tag{2}$$

Where $A_0$, $A_2$, $A_4$ and $A_6$ are expansion coefficients, $P_6(x,y)$ is a polynomial function of the sixth degree and $o(x,y)$ represents the sum of higher than sixth degree terms in the expansion series, U is the DC voltage applied the opposite pair of electrodes and V is the amplitude of the main RF voltage applied to the electrodes. The coefficients $A_2$ and $A_4$ are called quadrupole and octopole weighting coefficients, respectively. The percentage ratio $A_4/A_2$ defines the weighted contribution of the octopole field with respect to the contribution of the quadrupole field and can be used as a quantitative measure for the field distortion from the pure quadrupole field (referred to herein as the ratio of octopole field to the quadrupole field). Typically, for commercially available 2-D ion traps the quadrupole RF field is between approximately 0.5 Mhz and 2 Mhz. For such ion traps it is desirable to modify ion trap geometry from the ideal by adding an octopole field contribution to give an octopole field to quadrupole field ratio of about 0.2% to about 5% while minimizing higher order components of the expansion series. In some embodiments an octopole field to quadrupole field ratio of about 0.5% to about 2% is desirable. Typically, the optimum ratio is determined experimentally by identifying the ratio which yields the best resolution. Sufficient octopole contribution must be present to impact ion motion. Too much octopole contribution creates additional motion components that degrade resolution. The octopole contribution in combination with the method of applying supplemental resonance fields described herein allows one to achieve an improved isolation for the selected ions when eliminating unwanted ions from the ion trap.

Figure 3:
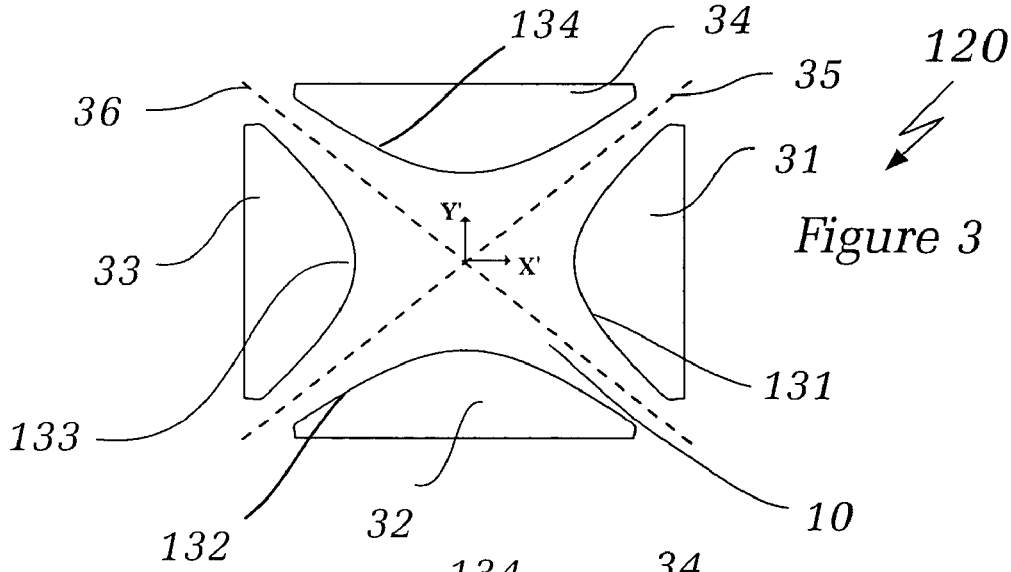
FIG. 3 is a schematic cross section diagram of one exemplary embodiment of a modified 2-D ion trap.
Figure 4:
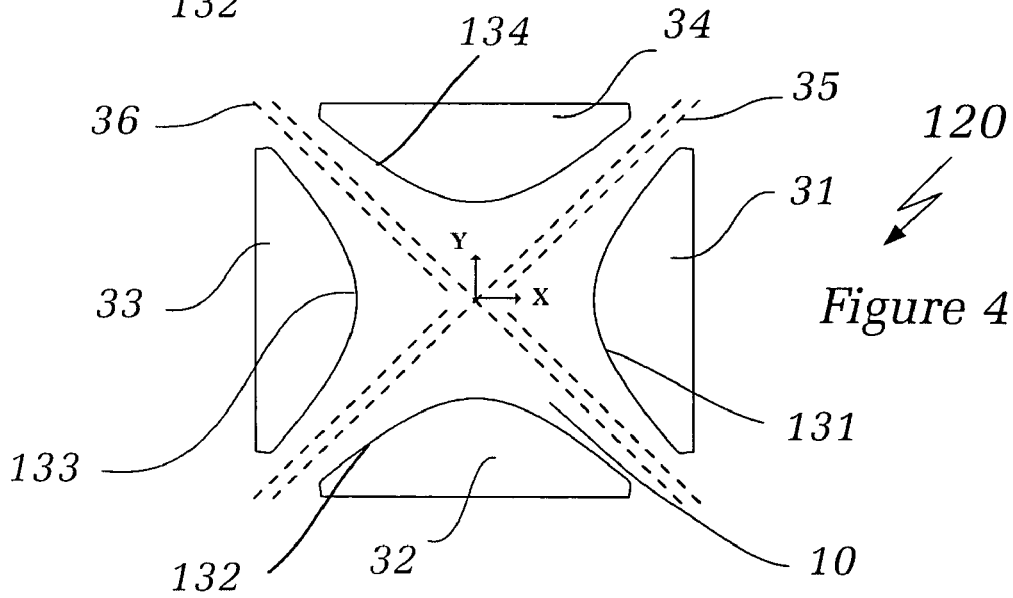
FIG. 4 is a schematic cross section diagram of one exemplary embodiment of a modified 2-D ion trap.

FIGS. 3 and 4 show exemplary embodiments of modified 2-D ion trap geometries using electrodes 31, 32, 33, 34 with modified geometries or modified electrode pair spacing. Electrodes 31, 32, 33, 34 have substantially hyperbolic inner surfaces 131, 132, 133, 134. In FIG. 3 the shape and dimensions of the electrodes 31, 32, 33, 34 are modified with respect to the shape and dimensions of an ideal 90 degree hyperbolic electrode. In FIG. 4, electrodes 31 and 33 are spaced at a distance apart greater than the distance that electrodes 32 and 34 are spaced apart.

More particularly, the ion trap geometry shown in FIG. 3 produces a trapping volume 10 having a quadrupole field with a small contribution of an octopole field in the x-y plane. The octopole field in the x-y plane is obtained by a non-uniform scaling of both electrode pair 32, 34 and electrode pair 31, 33 along the x and the y axis of each electrode of the pairs to form two electrode pairs 32, 34 and 31, 33 with modified geometry with respect to the 90 degree hyperbolic electrodes (e.g. the two asmytotes of the hyperbola no longer form a 90 degree angle). The dimensions of the modified electrodes pairs 32, 34 and 31, 33 can be obtained by multiplying the coordinates of an ideal hyperbolic electrode geometry with different scaling coefficients along x and y axis using the relationship:

$$X'=k_1X$$

$$Y'=k_2Y \quad (3)$$

where X' and Y' are the x and y axis dimensions of the modified electrode, X and Y are the ideal electrode dimensions along the z and y axis and $k_1$, and $k_2$ are scaling coefficients. The hyperbolic electrodes thus modified in shape and dimension such that the asymptotes no longer form a 90 degree angle are referred to hereinafter as stretched electrodes 31, 32, 33, 34.

In an exemplary embodiment $k_2=1/k_1$ and the value of $k_1$ is typically in the range of 1.01 to 1.2 to provide a suitable octopole field contribution. For the example shown in FIG. 3, the ideal 2-D ion trap geometry (refer to FIG. 2 for ideal example) was modified using scaling factors of $k_1=1.1$ and $k_2=1/k_1$. As shown in FIG. 2, the ideal quadrupole field is characterized by the presence of two orthogonal asymptotic lines 35 and 36 in ion trapping volume 10. However, the asymptotic lines 35, 36 in the modified geometry quadrupole field embodiment of FIG. 3 intersect at an angle that deviates from the 90 degree angle of the ideal quadropole field.

FIG. 4 shows an embodiment in which the ideal quadropole field geometry is modified to provide an octopole contribution by moving one pair of electrodes 31, 33 outward to increase the distance between them by a distance D. Thus, the distance separating the electrodes 31 and 33 is greater than the distance separating the pair of electrodes 32 and 34 which are spaced as they would be in an ideal quadrupole field.

Stretched electrodes or round rod electrodes may be used as electrodes in the 2-D ion trap of the invention. In general, the round rod electrodes are somewhat less expensive as compared to hyperbolic or stretched electrodes. Thus, round rod electrodes may offer an economic advantage.

Figure 5:
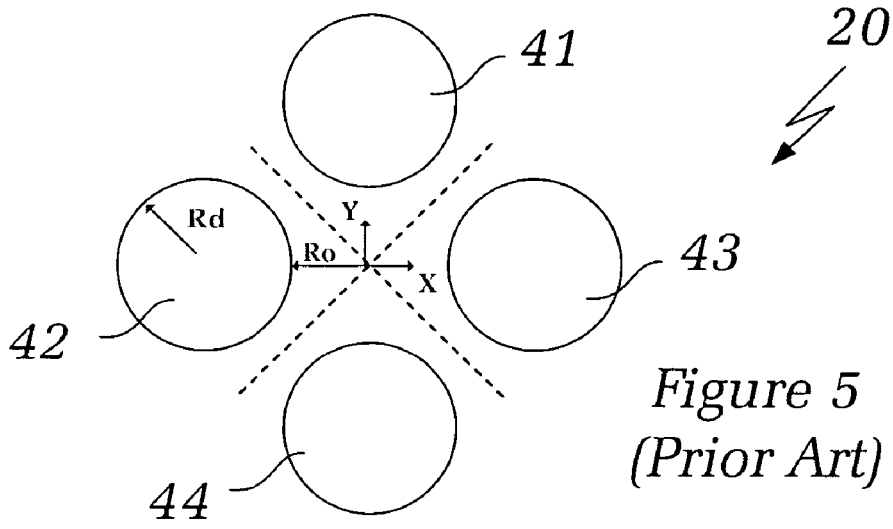
Figure 5 (Prior Art)
FIG. 5 is a schematic cross section diagram of a prior art 2-D ion trap with round rod electrodes.

Referring to FIG. 5, an exemplary prior art 2-D ion trap 20 with round rod electrodes 41, 42, 43, 44 in which round rods with radius of $R_d$ are spaced around a circle with radius $R_o$ is shown. The 2-D ion trap 20 of FIG. 5 has a near zero octopole term when radius ratios $R_d/R_o$ are within about 1.1 to about 1.14. The optimum ratio varies depending on whether the rods surround the chamber or are positioned in a shroud. The prior art ion trap 20 configuration shown in FIG. 5 has rod electrodes 41, 42, 43, 44 configured to have a near zero octapole term.

In one exemplary embodiment of a modified geometry 2-D ion trap 120 with round rod electrodes, an octopole field contribution is introduced without introducing any substantial higher order components to the quadropole field by scaling the radii of the two opposite pairs of electrodes in inverse proportion while keeping the same $R_o$. This transformation can be described mathematically by the set of equations:

$$Rxn=Rd/J_1$$

$$Ryn=Rd\ J_1$$

$$R_{on}=R_o, \quad (4)$$

where Rxn is the radius of the pair of rods aligned with the x axis, Ryn is the radius of the pair of rods aligned with the y axis, $R_{on}$ is the inscribed radius for the final geometry, $R_o$ is the inscribed radius for the undistorted geometry and $J_1$ is the scaling coefficient. In an exemplary embodiment, $J_1$ is selected to be about 1.0 to about 1.2.

Figure 6:
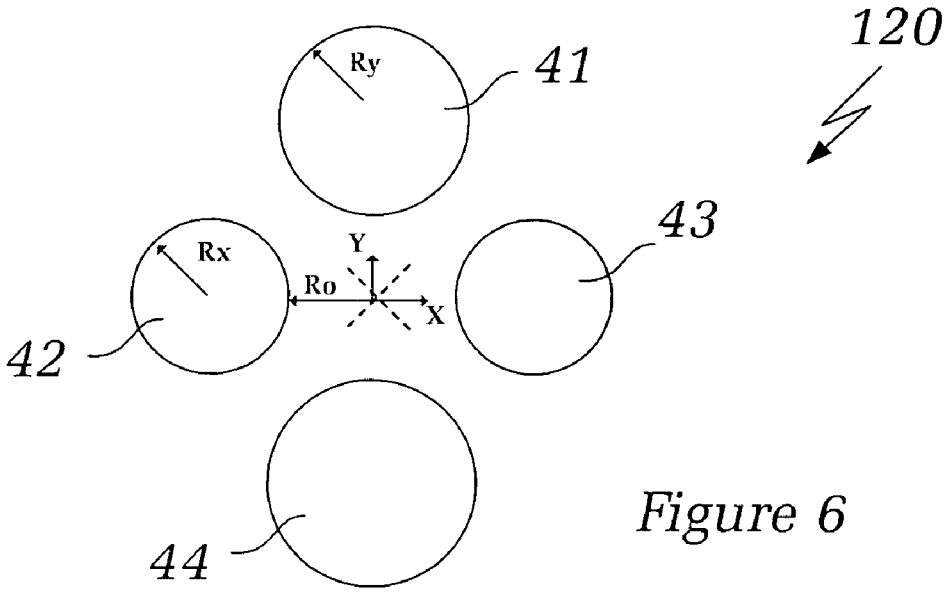
FIG. 6 is a schematic cross section diagram of one exemplary embodiment of a modified 2-D ion trap.

FIG. 6 is exemplary of the cross-section of a 2-D ion trap 120 with such a modification. As FIG. 6 shows, the electrodes of electrode pair 44, 41 have a different diameter than the electrodes of electrode pair 42, 43.

Figure 7:
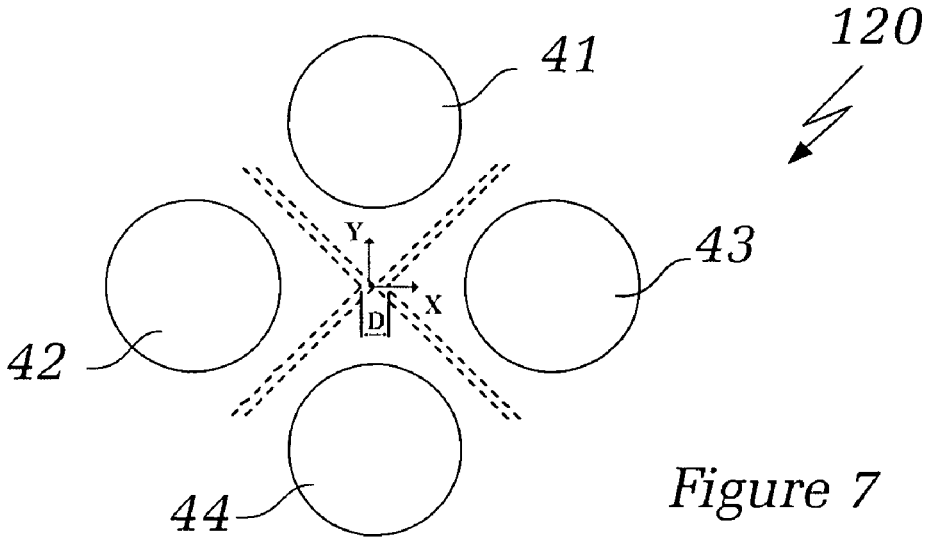
FIG. 7 is a schematic cross section diagram of one exemplary embodiment of a modified 2-D ion trap.

In another embodiment as shown in FIG. 7, an octopole term is added to the 2-D ion trap 20 with round electrodes 41, 42, 43, 44 by spacing two opposite round rod electrodes 42, 43 apart by a distance that is greater than the ideal spacing for rod electrodes in an ideal quadrupole field by a distance F. This is essentially the same type of geometry modification as shown in FIG. 4 for hyperbolic rod electrodes.

Alternatively, the electrode geometry modification may be accomplished by placing one or more slits in at least one of the electrodes of the electrode pairs and/or etching or engraving an indentation in the inner surface of one or more electrodes and/or adding a bulge to an inner surface of one or more electrodes.

The methods of modifying the physical geometry of electrodes that form the quadrupole field of a 2-D ion trap to provide an octopole contribution discussed herein are exemplary. Any other method that provides a suitable octapole field contribution to the quadropole field may be used.

Terminology used herein for the sign of the octopole field contribution as related to the main quadrupole field along a certain axis is as follows: The octopole contribution is positive along a certain coordinate axis if the sign of the coefficients of the expansion series as presented by equation 2 for the second power and the fourth power of that axis coordinate are the same. Accordingly, as equation 2 reveals, if the octopole field contribution is positive around one axis then it is negative around the orthogonal axis. For example, for the embodiments illustrated in FIGS. 3, 4, 6 and 7 the octopole term is positive around the x-axis and negative around the y-axis. Thus, for the 2-D ion traps 120 of FIGS. 3, 4, 5 and 7 the sign of the octopole contribution is opposite for the x and the y axis. However, the absolute value of the octopole contribution is about the same along the x and the y axis. These facts are derived from the fundamental Laplace equation for an electrostatic field. This invention provides an apparatus and method for utilizing these facts to enhance ion isolation in non-linear 2-D ion trap fields having an octopole field contribution.

Generally, trapping ions in an ion trap comprises either forming ions in the ion trap or admitting them to the ion trap from an ion source external to the quadrupole trapping volume. Typically, the ions have a range of m/z (e.g. mass to charge) values and include some ions of interest and other ions which may have m/z values larger or smaller than the ions of interest. To perform an MS/MS experiment or an ion/molecule reaction or the like, for example, it is best to remove the ions with m/z values larger or smaller than the ions of interest from the ion trap. This is generally done in a systematic manner by manipulating the motion of the ions. The systematic application of changing conditions to eject unwanted ions from the ion trap may be referred to as scanning. Once the ions of the m/z of interest are isolated, the MS/MS analyses or ion/molecule investigation or the like may be performed.

Typically, MS/MS experiments are performed in a 2-D ion trap by applying one or several supplemental waveforms to one pair of opposite electrodes to isolate the ions of interest. The applied wave-forms are selected to resonate with unwanted ions and eject the unwanted ions out of the ion trap, while attempting to preserve the ions of interest within the trapping volume. The wave forms may be quite complex and the process can be repeated several times to achieve the desired degree of isolation.

Ideally, the selection for the ions of interest in an MS/MS analyses should be as narrow as possible with respect to the nominal mass-to-charge (e.g. m/z) ratio of the ions of interest. This provides good discrimination and specificity. However if the isolation step is too narrow, then it may decrease the abundance of ions of interest and lower sensitivity. The desirable mass resolution for the isolation of the ions of interest is determined by the ratio of the m/z of the ions of interest to the width of the smallest window that does not discriminate against the intensity of the ions of interest to more than a 90% level. Another important parameter for ion isolation is total time that is required to complete the isolation. In general, the shortest possible isolation time is the most preferable, since it allows one to do a fast analysis with high duty cycle and also improves overall sensitivity of the apparatus.

Ion motion in a linear ion trap can be described as follows: When the DC voltage is zero (U=0), ion motion within the x-y plane of a linear ion trap in the presence of a supplemental sine wave, can be described using a pseudo-potential well approximation with assumption of decoupled x and y coordinates by the following equations:

$$\frac{d^2x}{dt^2} + \mu\frac{dx}{dt} + w_0^2x + A_4'x^3 = E_x\sin(wt) \tag{5a}$$

$$\frac{d^2y}{dt^2} + \mu\frac{dy}{dt} + w_0^2y + A_4'y^3 = E_y\sin(wt) \tag{5b}$$

where μ is the coefficient representing molecular drag or ion collisions with neutral molecules, due to the presence of the collisional gas in the ion trap, $A_4'$ is the octopole normalized term, and $E_x$ and $E_y$ are the coefficients representing the amplitude of the supplemental excitation field along the x and y axis (e.g. coordinates), respectively.

Figure 8:
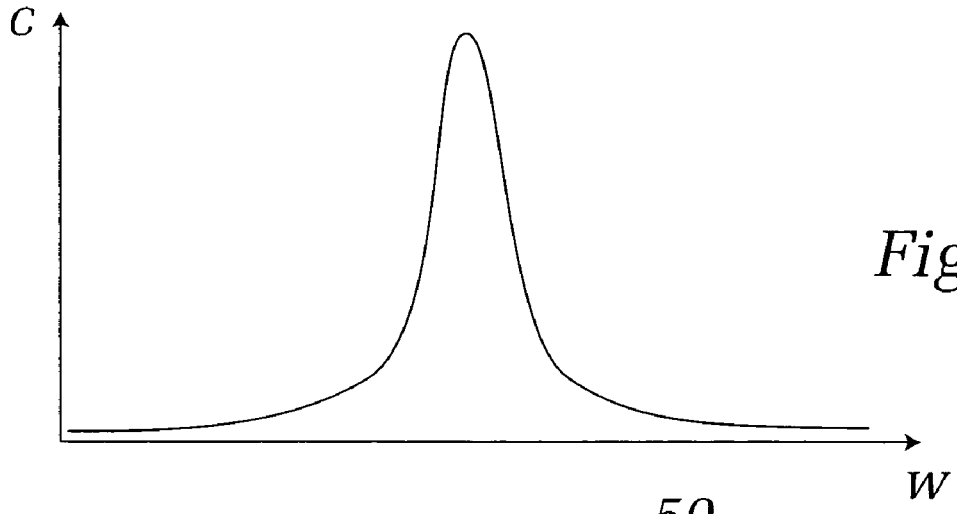
FIG. 8 is a diagrammatic representation of a resonance curve in an ideal quadrupole field.

If $E_x$ or $E_y$ are non-zero at the same time, Equations (5a) and (5b) can be treated independently. The resonance curves for these equations are presented in FIG. 9 for the x coordinate and in FIG. 10 for the y coordinate. Assuming that $A_4'>0$, this corresponds to the resonance curves for the modified 2-D ion trap 120 embodiments presented in FIGS. 3, 4, 5, and 6. FIG. 8 shows the classic resonance curve for a pure quadrupole ion trap field in the trapping volume which corresponds to $A_4'=0$ in equations (5a) and (5b).

Figure 9:
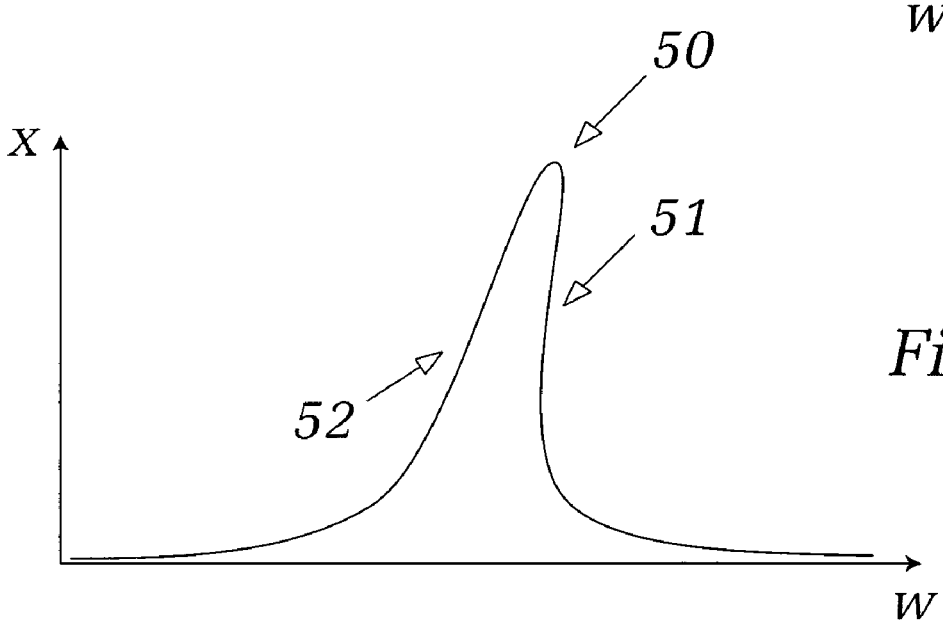
FIG. 9 is a diagrammatic representation of a resonance curve for the x coordinate in a non-linear quadrupole field.
Figure 10:
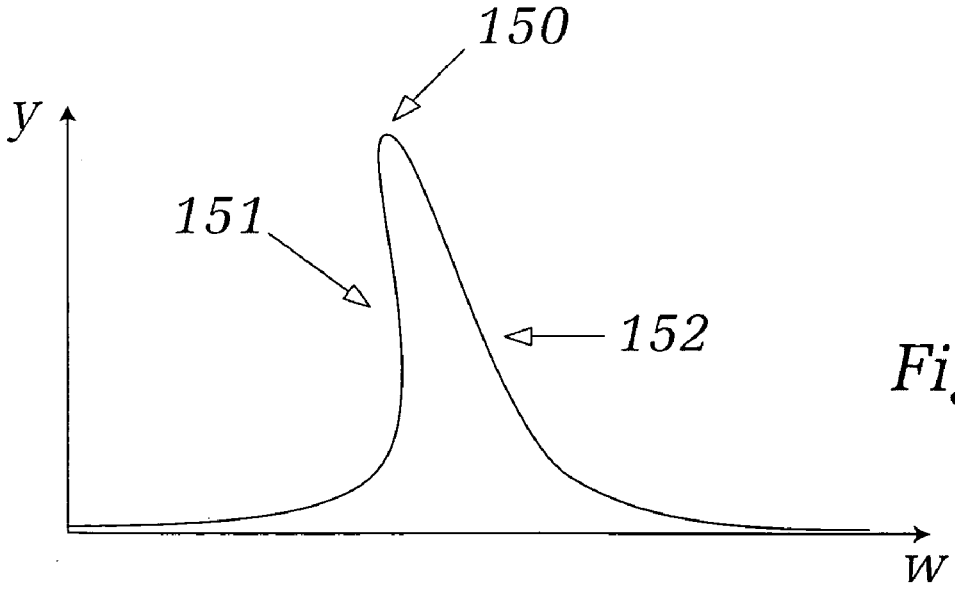
FIG. 10 is a diagrammatic representation of a resonance curve for the y coordinate in a non-linear quadrupole field.

For the modified ion traps 120 of the invention the resonance curves are non-linear resonance curves as shown in FIGS. 9 and 10. For the non-linear resonance curves of FIGS. 9 and 10, if the frequency of the supplemental excitation field w is selected to approach resonance from the steep sides 51, 151 rather then from the smooth sides 52, 152, a very sharp resonance condition can be achieved (e.g., a condition with resonance resolution substantially higher than can typically be achieved with a normal resonance curve such as the resonance curve shown in FIG. 8). In contrast to the 3-D ion traps, in the 2-D traps it is possible to have two forced non-linear resonances across the x axis and the y axis that have an opposite sign of the non-linearity. Further, it is possible to utilize these two forced non-linear resonances to force ion motion in x and y directions independently and sequentially in time.

Figure 11:
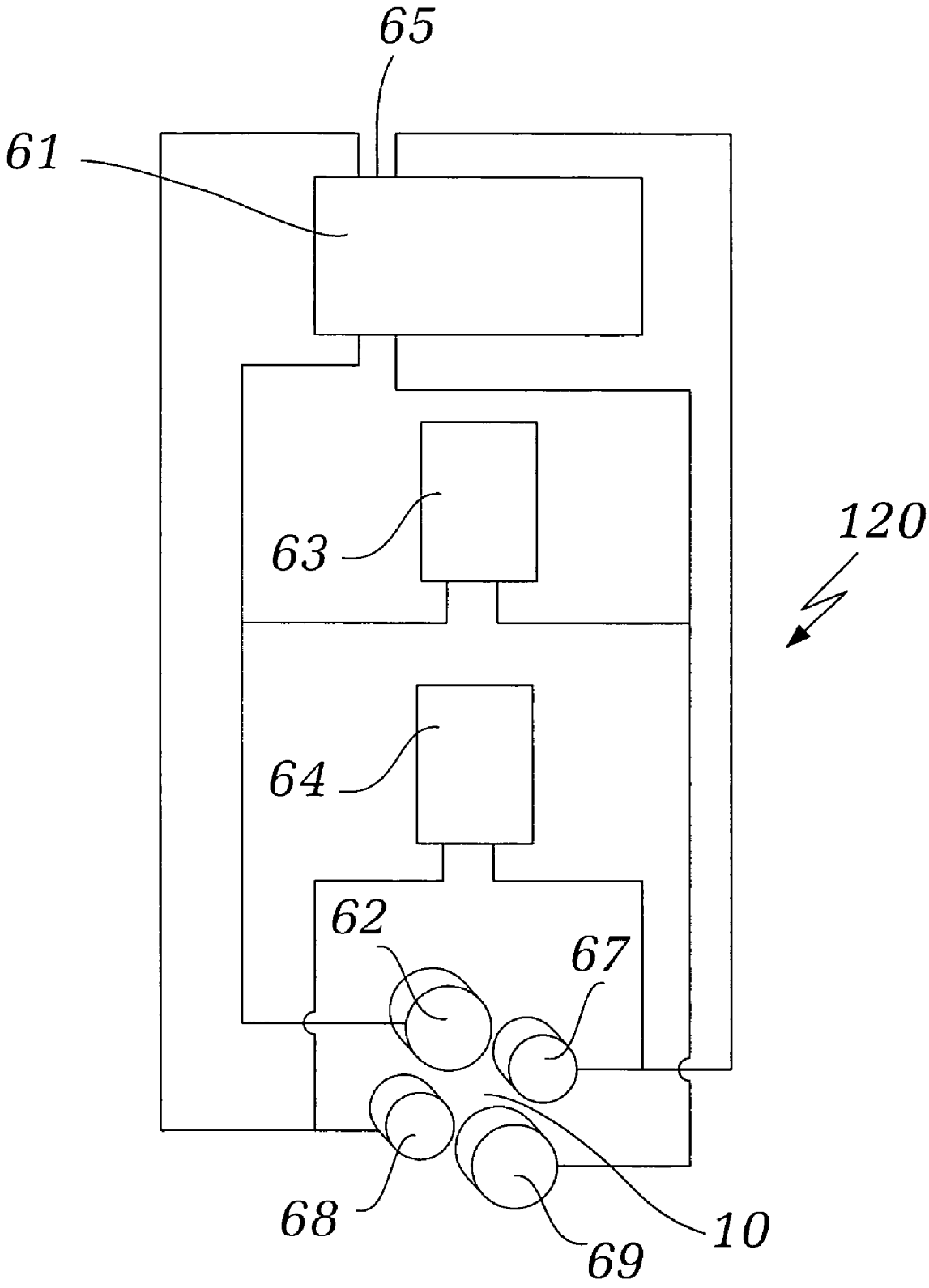
FIG. 11 is a schematic diagram of the relationship of field generators and electrodes in one exemplary embodiment.

In one embodiment, forcing ion motion in the x and the y directions independently is accomplished by using two supplemental wave form generators. A supplemental waveform generator is attached to each pair of rod electrodes. In this embodiment as shown in FIG. 11, a main radio frequency (e.g. RF) generator 61 provides a main RF voltage to two pairs of non symmetrical rod electrodes 62, 69, 67, 68 to create a main trapping field in trapping volume 10. Opposite rods are members of a pair of rod electrodes. Accordingly, rod electrodes 62 and 69 are a pair and are connected to the same phase of RF generator 61 and rod electrodes 67 and 68 are a pair and are connected to the same phase of the RF generator 61 but a different phase than rod electrode pair 62, 69. FIG. 11 shows two supplemental wave-form generators 63, 64. One supplemental wave form generator is attached to each pair of rod electrodes 62, 69 and 67, 68. The supplemental wave form generators 63, 64 can generate excitation waves with excitation wave frequencies. Further one of the supplemental wave form generators provides for excitation wave frequencies that can be scanned from high to low over time and the other supplemental wave frequency generator provides for excitation wave frequencies that be scanned from low to high over time.

Optionally, an arbitrary wave form generator may be used as the supplemental wave form generator. An arbitrary wave form generator is a device that is capable of generating a computer generated pre-calculated signal.

FIG. 11 is not an electrical schematic, but rather a diagram that illustrates the wave form and field generators 61, 63, 64 and indicates their relationship to the rod electrodes 62, 67, 68, 69 of the 2-D ion trap 120. Various types and methods of electrical schematics to accomplish the connection and operation of the apparatus may be used.

For the embodiment shown in FIG. 11 if the octopole term is assumed to be positive for the pair of rod electrodes 67 and 68 (x- axis), the octopole term would be negative for the rod electrodes 62, 69 (y- axis). Accordingly for this illustrative example, the ion motion in the y direction is the motion between the rods 62, 69 and the ion motion in the x direction is the motion between rods 67 and 68. When positive ions are introduced into the 2-D ion trap, the main RF generator 61 supplies an RF voltage of a trapping amplitude Vtr prior to the isolation procedure. Supplemental isolation frequencies are supplied by the supplemental wave form generators 63, 64 to isolate ions.

Figure 12:
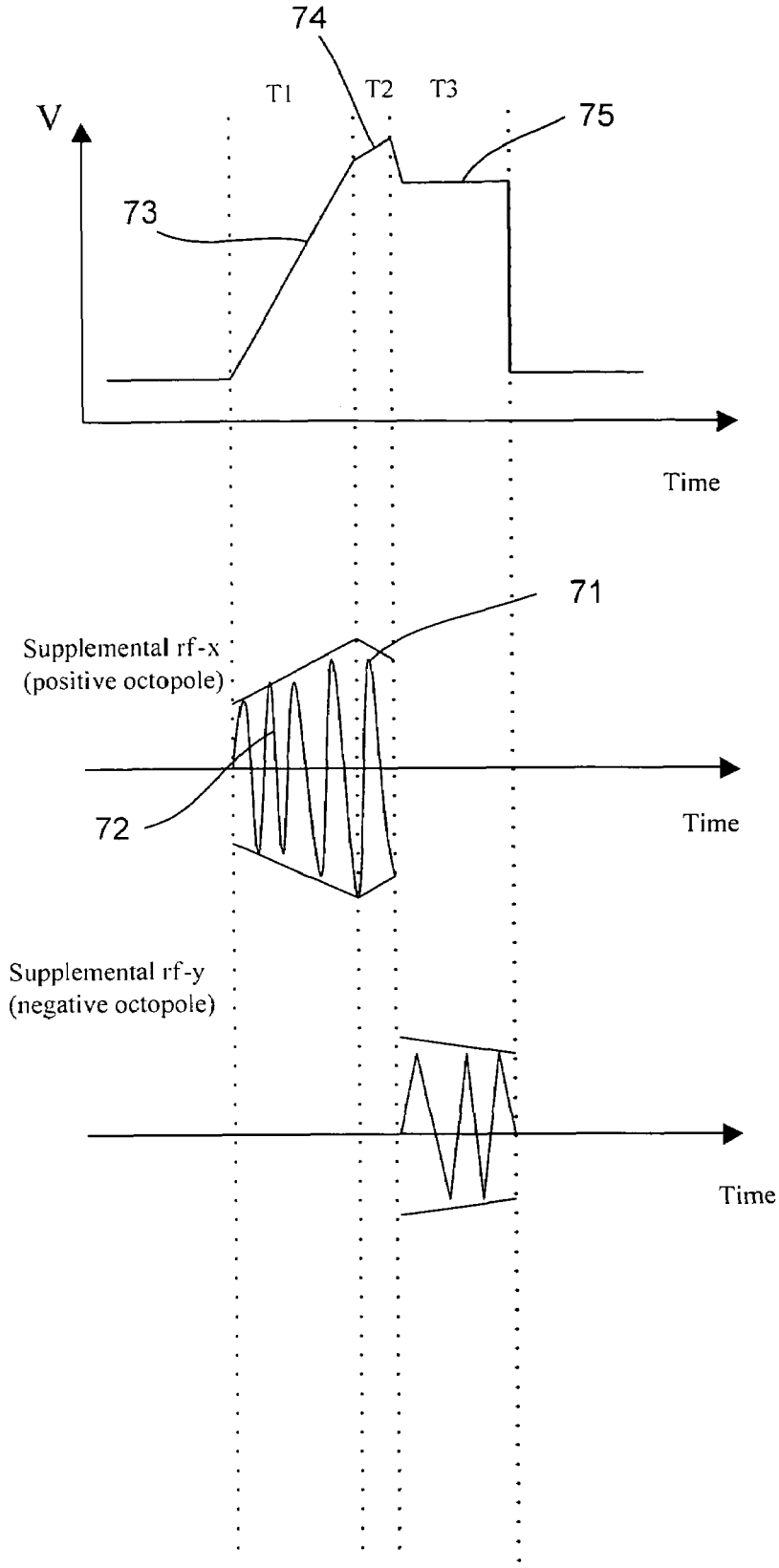
FIG. 12 is an exemplary wave form diagram for isolation of selected ions in one exemplary embodiment.

FIG. 12 shows an exemplary time diagram for the waveforms to be applied to the ion trap rod electrode to achieve isolation of selected ions in the trap, and near elimination of the non-selected ions from the ion trap. For this exemplary embodiment the isolation of a mass with a specific m/z ratio is accomplished first by ejecting all ions with m/z smaller than the m/z of ion of interest along one of the ion trap axis, with a certain octopole component, and then ejecting all ions with an m/z larger than the m/z of the ion of interest along the other axis with the opposite sign of the octopole component.

More specifically, in the exemplary time sequence presented in FIG. 12, as applied to the exemplary embodiment shown in FIG. 11, during the time interval T1 a single sign waveform curve portion 72 is output by the supplemental RF generator 64 (e.g. supplemental wave form generator) and applied to the rods with positive contribution for the octopole component 67, 68 (e.g., "x"-rods). At the same time, during the time interval T1, the main RF amplitude V is ramped as shown by curve portion position 73 to bring all the ions with the mass-to-charge ratio smaller than the m/z of the ion of interest into a sharp edge of a non-linear resonance curve (see FIG. 9 for a diagram of a non linear resonance curve). The ramping speed may be slowed at T2, as shown by curve portion 74, and the amplitude of the supplemental RF-x excitation field may be decreased, as shown by curved portion 71. In some examples this enhances separation near the m/z of the ions of interest. After the ions with m/z smaller than the m/z of the selected ion of interest have been ejected from the ion trap, the supplemental RF-x generator 64 is turned off and main RF amplitude is dropped to a somewhat lower value as shown in curve portion 75 of FIG. 12 to preserve the population of ions with the m/z of interest. During time period T3 all the masses with m/z larger than the m/z of the ions of interest will be ejected out of the 2-D ion trap. To eject the ions of m/z larger than the m/z of ions of interest, the supplemental RF generator-y, 63 is turned on to output a chirp wave-form with frequency increasing with time.

An exemplary chirp wave form that can be used in the practice of the invention may be described by the equation sin ($\nu(t)t$), where $\nu=\nu_t+\alpha t$. Alternatively, a chirp-like wave form such as the wave form that can be obtained using the SWIFT technique may be used. In SWIFT the wave form is obtained by addition of a plurality of sine waves with quadratic modulation for the phases with an increase of the average spectral frequencies in time during the wave-form duration. When the chirp or chirp-like wave form is applied, ions with an m/z larger than the m/z of the ions of interest will fall into resonance by intercepting the sharp edge of the reversed y-resonance curve (see FIG. 10 for y-resonance curve). The SWIFT technique was developed for FT ICR MS by A. Marshall. (See also: U.S. Pat. No. 4,761,545 A, and U.S. Pat. No. 5,696,376)

In practice, a complex arbitrary wave is designated as having a wave form with a frequency change from a low frequency to high frequency if the original frequency wave form can be segmented mathematically into a finite number of time segments and after taking Fourier transformation for each of the segments the resulting frequencies of the wave form components substantially increase from one segment to another, respectively. Similarly, a complex arbitrary wave is designated as having a wave form with a frequency change from a high frequency to low frequency if the original frequency wave form can be segmented mathematically into a finite number of time segments and after taking Fourier transformation for each of the segments the resulting frequencies of the wave form components substantially decrease from one segment to another, respectively. For this designation, only major frequency components that are presented with substantial intensities that can effect ion motion are considered.

For both ions with m/z smaller than the m/z of the ions of interest and for ions with m/z larger than the m/z of the ions of interest, it is possible to achieve non-linear resonance ejection though the sharp (near vertical) edge of a resonance curve. This yields the end result of an isolation window with a symmetrical shape. Typically, it also provides faster rates of ramping resonance parameters than with a conventional 2-D ion trap and typically overall shorter isolation times. The procedure, as described herein, can be repeated in sequence to eliminate nearly all ions that may result due to ion molecule reactions, ions/ion reactions or dissociation reactions within the trap.

For many applications, a single isolation sequence may be sufficient. However, after the initial isolation of the ion of interest, sequential repetition of this isolation procedure can be beneficial in some applications, for example, to address large space charge conditions. Optionally, in applications where space charge conditions are an issue, a first round initial isolation including only a T1 step executed at relatively high ramp rates (such as 50-100 Kda/s) using a wide isolation window (e.g., the order of 20 Da) can be used. In an exemplary embodiment, the time for this initial isolation procedure may be about 10 to 20 ms. A second isolation round can then be performed as shown in FIG. 12 at slower ramping speed and using a narrower fine isolation window width (for example as the order of 1 Da or smaller) to complete the isolation process.

Figure 13:
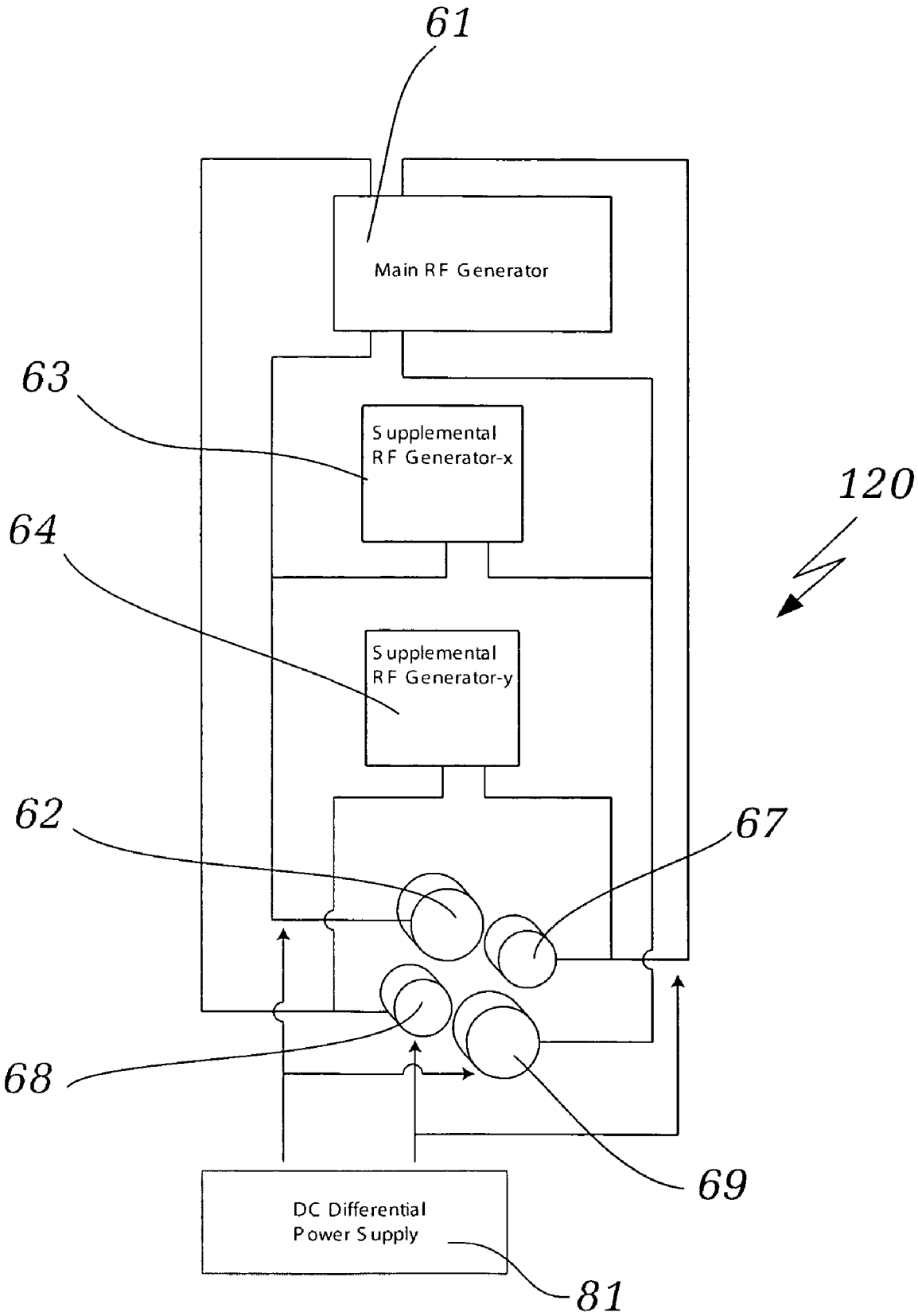
FIG. 13 shows a schematic diagram of the relationship of the field generator, electrodes and differential power supply in an exemplary embodiment.

FIG. 13 shows a schematic representation of another embodiment of the invention. In this embodiment an additional differential power supply 81 is connected to the 2-D ion trap 120 rod electrodes 62, 67, 68, 69 in such a way that opposite rods are connected to the same polarity while the adjacent rods are connected to the opposite polarity. The differential power supply 81 provides a differential voltage to the 2-D trap rods 62, 67, 68, 69 making the main frequency of the resonance oscillations $w_0$ somewhat different for the motion along x and y axis (e.g., $w_x$ is not equal to $w_y$). The ion motion in this exemplary embodiment is described by the equations:

$$\frac{d^2x}{dt^2}+\mu\frac{dx}{dt}=w_x^2x+A'_{4DCx}x^3=E_x\sin(wt) \tag{6a}$$

$$\frac{d^2y}{dt^2}+\mu\frac{dy}{dt}+w_y^2y-A'_{4DCy}y^3=E_y\sin(wt) \tag{6b}$$

where $w_x$ and $w_y$, are ion oscillation fundamental frequencies along the x and the y axis respectively and the other terms are as defined for equations (5a) and (5b). Equations 5a and 5b assume an approximation of small coupling between x and y motions. To satisfy this condition, the initial ion position has to be close to (0,0). The x-y coupling makes the resonance curves somewhat time dependent and somewhat diffused. In some applications x-y coupling can compromise the resolution of the isolation. Coupling between x and y oscillations is inversely proportional to the difference ($\Delta$) in frequencies for the x and y fundamental oscillations. Accordingly, providing an additional DC voltage can provide decoupling between x and y motions and yield higher isolation resolution. Additionally, the DC voltage provides a parameter that facilitates fine adjustments of the contribution of the octopole terms (A'4DCx and A'4DCx) without changing the trap electrodes' physical geometry.

Figure 14:
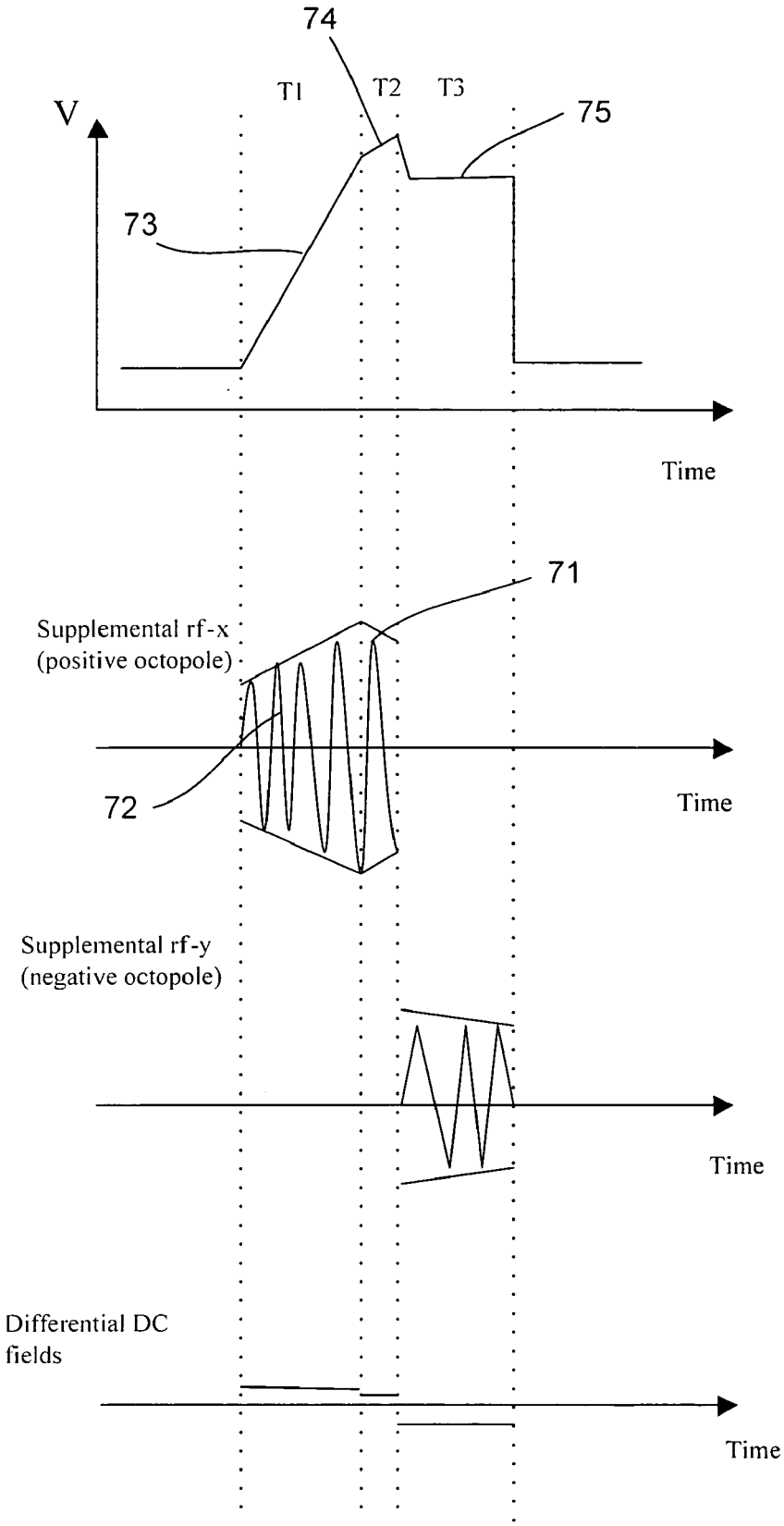
FIG. 14 shows an exemplary wave form diagram for isolation of selected ions in an exemplary embodiment.

FIG. 14 shows an exemplary time wave-form diagram for application of wave-forms to accomplish isolation of a selected ion in the ion trap embodiment of FIG. 13. The difference between the time diagram of FIG. 12 and FIG. 14 is the presence of the additional DC field during the T1, T2 and T3 time periods in FIG. 14. Referring to FIG. 14, the DC field strength and polarity can be adjusted individually during T1, T2 and T3 time intervals to achieve sharper isolation with a minimum time spent on each isolation period. The ions with m/z smaller than m/z of the ions of interest are ejected along the x axis and ions having an m/z larger than the ion of interest are ejected along the y axis.

Figure 15:
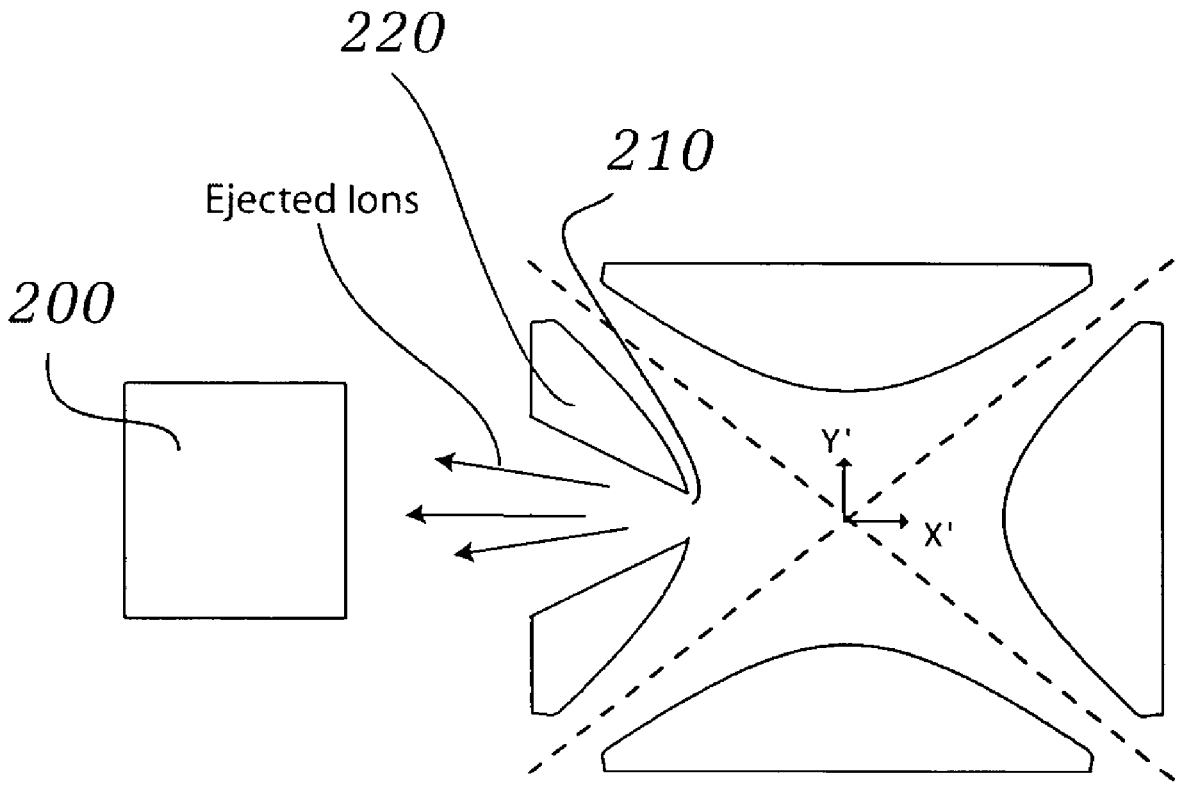
FIG. 15 is a schematic cross section diagram of one exemplary embodiment of a modified 2-D ion trap.

In some applications, it is desirable to detect ions ejected from the ion trap. As FIG. 15 shows ions ejected out of the trap due to the application of frequency changing wave forms can be directed into a ion detector 200 such as an electron multiplier, for example, through a slit 210 in one or more ion trap electrodes 220. Detection of these ejected ions provides the data used to generate a mass spectrum. The time-frequency spectrum of the applied waveform defines the mass axis calibration for the mass spectrum as the applied frequency is matched to the resonant frequency of the ejected ion. When applied wave forms that have frequencies that change from high to low or from low to high are used, the ejected ions arrive at the ion detector sequentially in time based on their mass-to-charge ratio.

Figure 16:
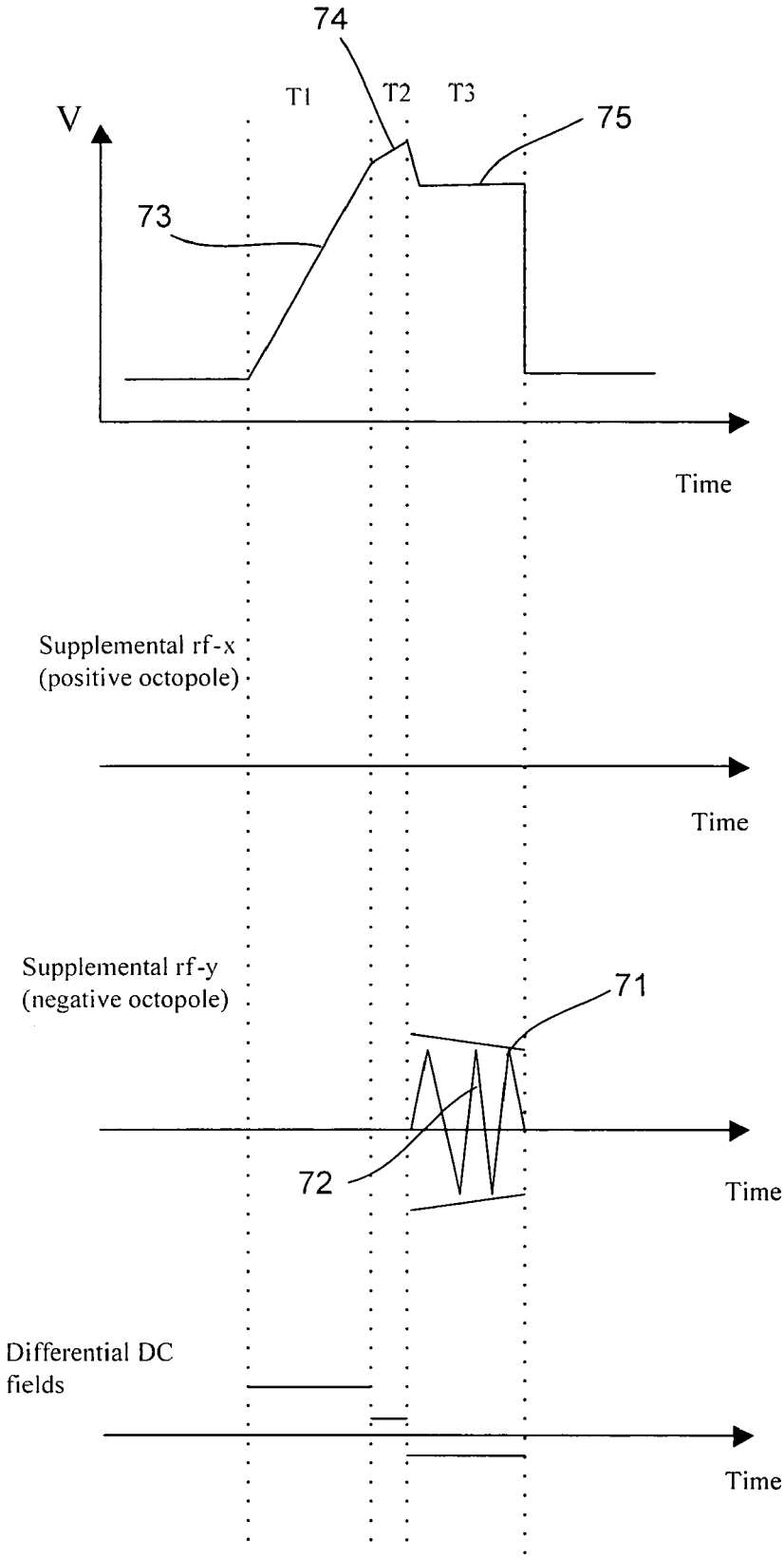
FIG. 16 shows an exemplary wave form diagram for isolation of selected ions in an exemplary embodiment.

In one exemplary embodiment of the 2-D ion trap, it is possible to use a fast ejection of all the ions below the m/z of the ion of interest by utilizing the border of the main stability region without using the supplemental generator 64. An exemplary time diagram for this embodiment is shown in FIG. 16. In this example, the positive phase of the differential DC power supply 81 is connected to the x-rod electrodes 67, 68 while negative phase of the differential power supply is connected to the y-rod electrodes 62, 69 during T1 period. (In this embodiment, the applied D.C. field forces motion in the first direction.) The value of the DC field can be adjusted experimentally to optimize the sharpness of the ejection at a particular ramp. As with other embodiments, optionally, isolation steps may be repeated at smaller ramping rates to achieve the higher isolation resolution.

The foregoing discussion discloses and describes many exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

The invention claimed is:

1. A method for trapping ions in a 2-D ion trap comprising:

generating an RF quadrupole field in a trapping volume;

generating an octopole field in the trapping volume;

providing ions in the trapping volume;

generating a first excitation wave in the trapping volume wherein the first excitation wave has a first excitation wave frequency and wherein the first excitation wave frequency changes from a higher frequency to a lower frequency over time and changes from a lower amplitude to a higher amplitude over time, wherein the first excitation wave forces motion of ions in the trapping volume in a first direction; and generating a second excitation wave wherein the second excitation wave has a second wave excitation frequency and wherein the second excitation wave frequency changes from a lower frequency to a higher frequency over time and changes from a higher amplitude to a lower amplitude over time, wherein the second excitation wave forces motion of ions in the trapping volume in a second direction and wherein the first and the second excitation waves are generated independently and sequentially.

2. The method of claim 1 further comprising:

generating a DC field in the trapping volume; and controlling the DC field to have a first amplitude during the generation of the first excitation wave and a different, second amplitude during the generation of the second excitation wave.

3. The method of claim 1 wherein the first excitation wave frequency changes from a higher frequency to a lower frequency over time at a rate of between 50-100 Kda per second.

4. The method of claim 1 wherein the first excitation wave frequency is generated for a period of between 10-20 ms.

5. An ion trap comprising:

a trapping chamber including a plurality of electrodes defining a trapping volume;

a circuit for providing an RF quadrupole field in the trapping volume to trap ions in a predetermined range of mass to charge ratios wherein the quadrupole field has a planar x-y geometry having a first direction and a second direction;

a circuit for providing an octopole field in the trapping volume;

a first supplemental wave form generator for generating a first waveform with decreasing frequency and increasing amplitude over time, wherein the first wave form generator forces motion of ions in the trapping volume in the first direction; and a second supplemental wave form generator for generating a second waveform with increasing frequency and decreasing amplitude over time, wherein the second wave form generator forces motion of ions in the trapping volume in the second direction.

6. The ion trap of claim 5 wherein the first wave form generator and the second wave form generator force motion of ions in the trapping volume independently and sequentially.

7. The ion trap of claim 5 wherein a ratio of the octopole field contribution to the RF quadrupole field contribution falls in a range of 0.2% to 5%.

8. The ion trap of claim 5 wherein a ratio of the octopole field contribution to the RF quadrupole field contribution falls in a range of 0.5% to 2%.

9. The ion trap of claim 5 wherein the plurality of electrodes are round rod electrodes.

10. The ion trap of claim 5 wherein the plurality of electrodes are electrodes with substantially hyperbolic inner surfaces.

11. An ion trap comprising:

a trapping chamber including a plurality of electrodes defining a trapping volume;

a means for establishing and maintaining a substantially quadrupole RF field in the trapping volume to trap ions in a predetermined range of mass to charge ratios wherein the quadrupole RF field has a planar x-y geometry having a first direction and a second direction;

a means for distorting the planar x-y geometry of the RF quadrupole field;

a means for introducing or a means for forming ions in the trapping volume;

a first means for generating an excitation wave wherein the first means for generating an excitation wave provides an excitation wave wherein the excitation wave frequency changes from a higher frequency to a lower frequency over time and changes from a smaller amplitude to a greater amplitude over time; and a second means for generating an excitation wave, wherein the second means for generating an excitation wave provides an excitation wave wherein the excitation wave frequency changes from a lower frequency to a higher frequency over time and changes from a greater amplitude to a smaller amplitude over time.

12. The ion trap of claim 11 wherein the means for distorting the quadropole RF field planar x-y geometry is a means for establishing an octopole field.

13. The ion trap of claim 11 wherein a ratio of the octopole field contribution to the quadrupole RF field contribution falls in a range of 0.2% to 5%.

14. The ion trap of claim 11 wherein a ratio of the octopole field contribution to the quadrupole RF filed contribution falls in a range of 0.5% to 2%.

15. The ion trap of claim 11 wherein the plurality of electrodes comprises a first pair and a second pair of electrodes and wherein the means for distorting the planar x-y geometry comprises spacing the electrodes of the first pair of electrodes at a spacing different from the spacing of the electrodes of the second pair of electrodes.

16. The ion trap of claim 11 wherein the plurality of electrodes comprises a first pair and a second pair of electrodes and wherein the means for distorting the planar x-y geometry comprises providing at least two stretched electrodes that are distorted, wherein the shape of each stretched electrode is a spatial stretch along a first electrode axis and a proportional linear compression along a second electrode axis orthogonal to the first electrode axis.

17. The ion trap of claim 11 wherein the plurality of electrodes comprises a first and a second pair of electrodes, and wherein the means for distorting the planar x-y geometry comprises slits in the electrodes of at least one of the electrode pairs.

18. The ion trap of claim 11 wherein the plurality of electrodes comprises a first pair of electrodes and a second pair of electrodes, and wherein the first means for generating an excitation frequency is a first supplemental wave form generator and the second means for generating an excitation frequency is a second supplemental wave form generator, and wherein the first supplemental wave form generator is connected to the first pair of electrodes and the second supplemental wave form generator is connected to the second pair of electrodes.

19. The ion trap of claim 18, wherein the first and second supplemental wave form generators are arbitrary wave form generators.

20. The ion trap of claim 11 further comprising a means for decoupling an ion motion in the first direction and an ion motion in the second direction.

21. The ion trap of claim 11 further comprising an ion detector and wherein at least one of the first and the second means for generating an excitation wave provides an excitation wave that changes wave frequency over time to eject ions from the trapping volume to the ion detector sequentially.

* * * * *